US006144752A

United States Patent [19]

Chen

[11] Patent Number: 6,144,752

[45] Date of Patent: Nov. 7, 2000

[54] SPEAKER CABINET APPARATUS

[76] Inventor: Su-Yue Chen, No. 93, Sec. 1 Hsing-nan Road, Chong Ho City, Taipei County, Taiwan

[21] Appl. No.: 09/356,910

[22] Filed: Jul. 20, 1999

[51] Int. Cl.[7] ..... H04R 25/00

[52] U.S. Cl. ..... 381/386; 381/345; 381/189; 181/199

[58] Field of Search ..... 381/87, 89, 332, 381/333, 353, 354, 150, 345, 386, 388, 391, 189, FOR 151, FOR 165; 181/155, 156, 199, 151; 362/279, 410

[56] References Cited

U.S. PATENT DOCUMENTS 2,559,045 7/1951 Petel ..... 181/151

4,817,163 3/1989 Stastny ..... 381/150

5,886,304 3/1999 Schlenzig et al. ..... 181/155

FOREIGN PATENT DOCUMENTS 1-149598 6/1989 Japan ..... 381/FOR 165

*Primary Examiner*—Huyen Le

*Attorney, Agent, or Firm*—Rosenberg, Klein & Lee

[57] ABSTRACT

A speaker cabinet apparatus comprising an arc-shaped concave straight groove respectively on two sides of a face plate with one or two speakers combined, or an arc-shaped concave ring groove around the speaker, or a combination of groove structures a means for lighting.

1 Claim, 1 Drawing Sheet

SPEAKER CABINET APPARATUS

BACKGROUND OF THE INVENTION

1. Field of the Invention

The present invention is directed to a speaker cabinet apparatus, especially for a mechanism in front of a speaker to give out haloes, or light strips, or both simultaneously to promote an atmosphere, or lasting appeal on the occasion during which the said speaker cabinet apparatus is in use.

2. Prior Art

Presently, a speaker cabinet is a necessary component of the high-grade acoustics. However, because of improved living standards, the emphasis on the atmosphere of special occasions, and demands for stereos having lasting appeal, not only should the structure of speaker cabinets satisfy the above purposes but should also possess value-added features such as increasing the pleasantness of the atmosphere under which it is used to correspond with market demands.

SUMMARY OF THE INVENTION

The present invention is a speaker cabinet apparatus comprising an arc-shaped concave straight groove on both sides of a face plate with one or two speakers combined, or an arc-shaped concave ring groove around the speaker, or a structure combining both of the said grooves with a means for lighting. It consists of a straight-shaped neon tube on both sides of the faceplate, or a ring-shaped neon tube around the speaker, or two neon tubes inserted in the grooves. When the speaker cabinet is in use, it produces haloes, or light strips, or both effects simultaneously.

DESCRIPTION OF THE PREFERRED EMBODIMENT

Figure 1:
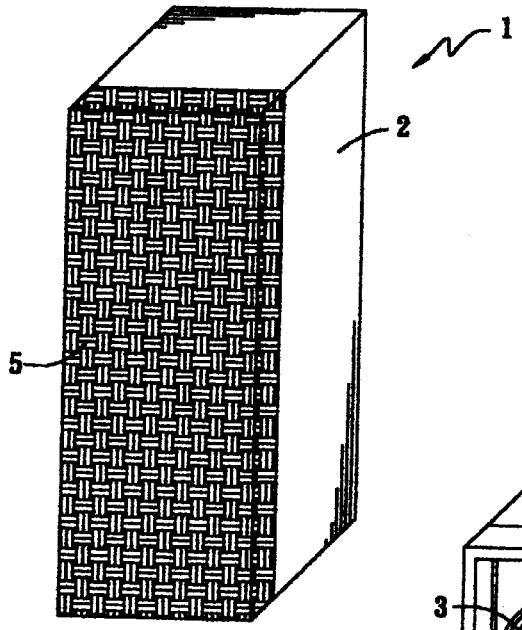
FIG. 1 is a perspective view of the present invention.
Figure 2:
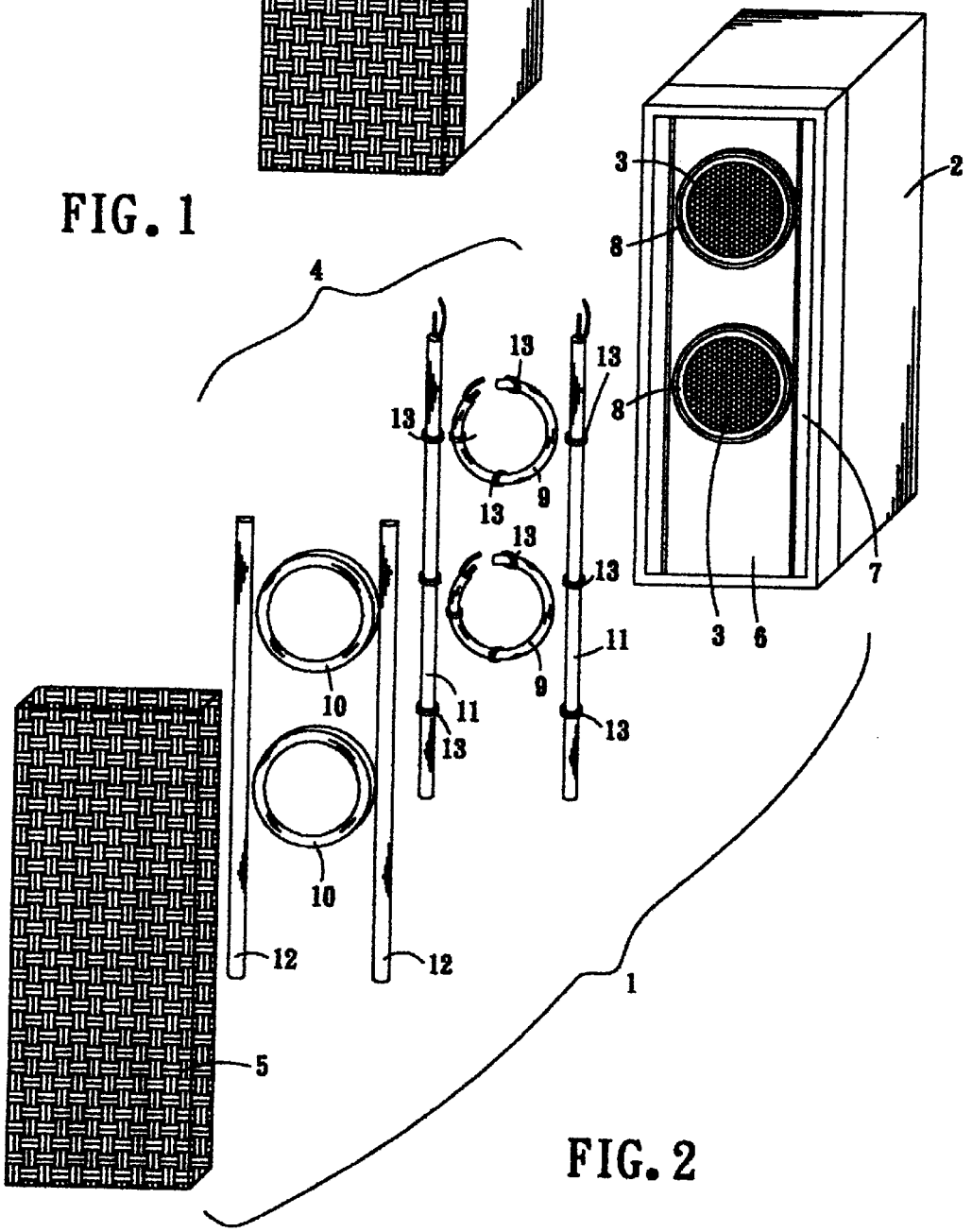
FIG. 2 is an exploded view of the FIG. 1

FIGS. 1 and 2 shows a speaker cabinet apparatus (1), a cabinet (2), a speaker (3), a means for lighting (4), and a cover (5). The structure of a cabinet (2) is almost the same as the prior art except for the fact that the said cabinet is structured with grooves with a means for lighting (4). The arc-shaped concave straight groove (7) located on both sides of the face plate (6) or the arc-shaped concave ring groove (8) around the speaker (3) can stand alone or united with the faceplate (6) of the cabinet (2).

Referring further to FIG. 2, the apparatus for lighting (4) consists of a ring-shaped neon tube (9) and a ring-shaped light-transmitting cover (10). Alternatively, it may be made with a combination of a straight neon tube (11) and a straight light-transmitting cover (12). As a further alternative, the lighting apparatus (4) may be made with a neon tube (9) and a ringed-shaped light-transmitting cover (10) combined with a straight neon tube (11) and a straight light-transmitting cover (12). The ring-shaped neon tube (9) corresponds with the shape and size of a concave ring groove (8) located on the face plate (6) of the cabinet (2). The neon tube (9) is inserted into the groove. Similarly, the straight-shaped neon tube (11) corresponds with a concave straight groove (7). Around the outer rim of the neon tube (9) and (11), there is a plurality of absorber springs (13), made of heat-resisting material. After the ring-shaped neon tube (9) is inserted into the concave ring groove 8 and the straight-shaped neon tube (11) is inserted into the concave straight groove 7, a plurality of the absorber springs (13) located within the concave ring groove (8) and the concave straight groove (7) is installed to absorb vibration from a face plate (6) and to prevent both the ring-shaped neon tube (9) and the straight-shaped neon tube (11) from being damaged by excessive movement. In order to prevent the cover (5) from coming into direct contact with the neon tube (9, 11), the ring-shaped light-transmitting cover (10) is fitted over the concave ring groove (8) while the straight-shaped light-transmitting cover (12) is fitted over the concave straight groove (7). Through the above light-transmitting cover (10, 12), the face plate (6) emanates soft haloes, light stripes or both lighting effect simultaneously.

What is claimed is:

1. A speaker cabinet apparatus comprising:

a cabinet, an arc-shaped concave straight groove positioned on both sides of a face plate; or a cabinet with an arc-shaped concave ring groove; or a cabinet with both of the said grooves, into which are a straight-shaped neon tube or a ring-shaped neon tube is inserted;

a speaker positioned and combined separately with the said face plate of said cabinet; and, a means for lighting, consisting of the said straight-shaped neon tube and a straight-shaped light-transmitting cover which are installed into the said arc-shaped concave straight groove, and a plurality of absorber springs around said straight-shaped neon tube; or a means for lighting consisting of the said ring-shaped neon tube, a ring-shaped light-transmission cover which are set in said arc-shaped concave straight groove, and a plurality of said absorber springs around said ring-shaped neon tube; or a means of lighting consisting of the said straight-shaped neon tube, the said straight-shaped light-transmission cover, a plurality of said absorber springs, the said ring-shaped neon tube, the said ring-shaped light-transmission cover, wherein the lighting mechanism produces haloes, or light strips, or both simultaneously when the said speaker is in use.

* * * * *